United States Patent [19]

Haehne

[11] Patent Number: 5,072,772

[45] Date of Patent: Dec. 17, 1991

[54] METHOD FOR MOULDING OBJECTS AND INSTALLATIONS FOR CARRYING OUT THE PROCESS

[76] Inventor: Siegfried Haehne, Rue du Mauvais Pas, 80140 Saint Maulvis, France

[21] Appl. No.: 398,661

[22] Filed: Aug. 25, 1989

[30] Foreign Application Priority Data

Sep. 2, 1988 [FR] France ..... 88 11663

[51] Int. Cl.[5] ..... B22D 18/02; B22D 41/14

[52] U.S. Cl. ..... 164/133; 164/120; 164/136; 164/337

[58] Field of Search ..... 164/113, 120, 133, 136, 164/319, 321, 337

[56] References Cited

U.S. PATENT DOCUMENTS

| | | | |
|---|---|---|---|
| 3,628,598 | 12/1971 | MacNeill | 164/337 |
| 4,505,318 | 3/1985 | Tokui | 164/113 |
| 4,519,436 | 5/1985 | Ebisawa | 164/113 |
| 4,730,658 | 3/1988 | Nakano | 164/113 |

FOREIGN PATENT DOCUMENTS

| | | | |
|---|---|---|---|
| 55-10381 | 1/1980 | Japan | 164/319 |
| 55-40078 | 3/1980 | Japan | 164/120 |
| 57-97861 | 6/1982 | Japan | 164/120 |
| 57-100860 | 6/1982 | Japan | 164/120 |
| 57-171559 | 10/1982 | Japan | 164/120 |
| 59-110455 | 6/1984 | Japan | 164/319 |
| 60-154860 | 8/1985 | Japan | 164/337 |
| 61-27162 | 2/1986 | Japan | 164/319 |

*Primary Examiner*—Richard K. Seidel
*Assistant Examiner*—Rex E. Pelto
*Attorney, Agent, or Firm*—Kerkam, Stowell, Kondracki & Clarke

[57] ABSTRACT

The invention concerns a method for moulding objects by feeding at least one consistent material into a mould where it solidifies prior to closing the inlet or opening of each runner of a cavity by means of at least one closing device, the gate feeding face of the runner of the cavity in question is closed, and then the molten material contained in the runner is expelled from the mould.

5 Claims, 4 Drawing Sheets

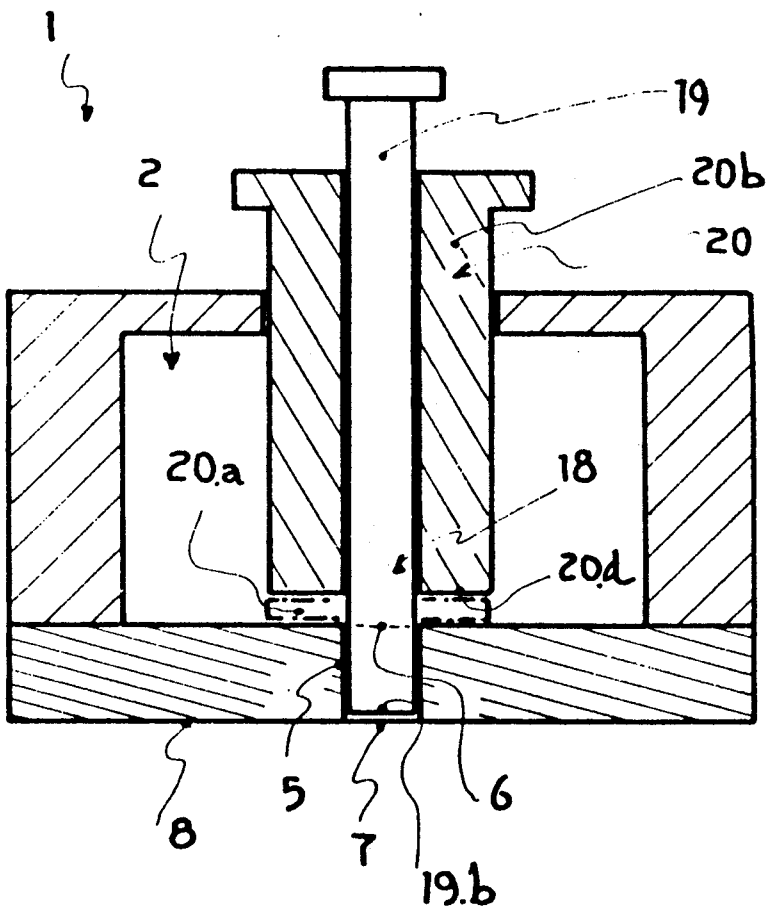
-Fig: 7-
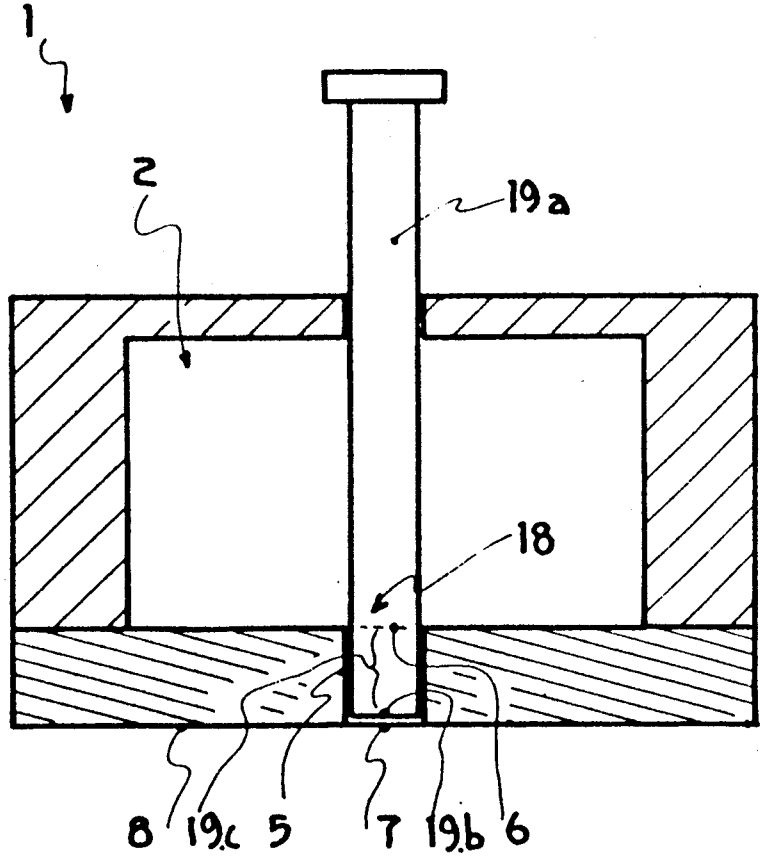
-Fig: 6-

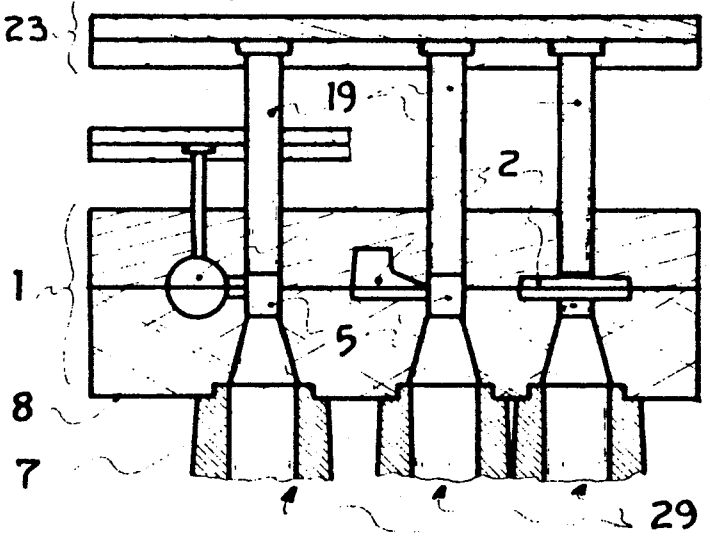
- fig: 9 -
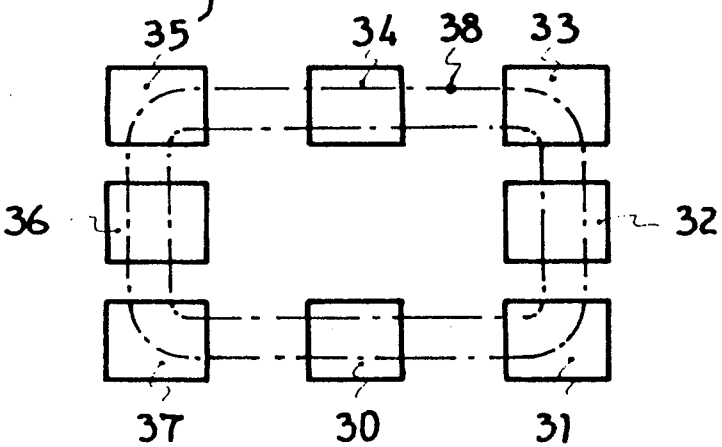
- fig: 10 -
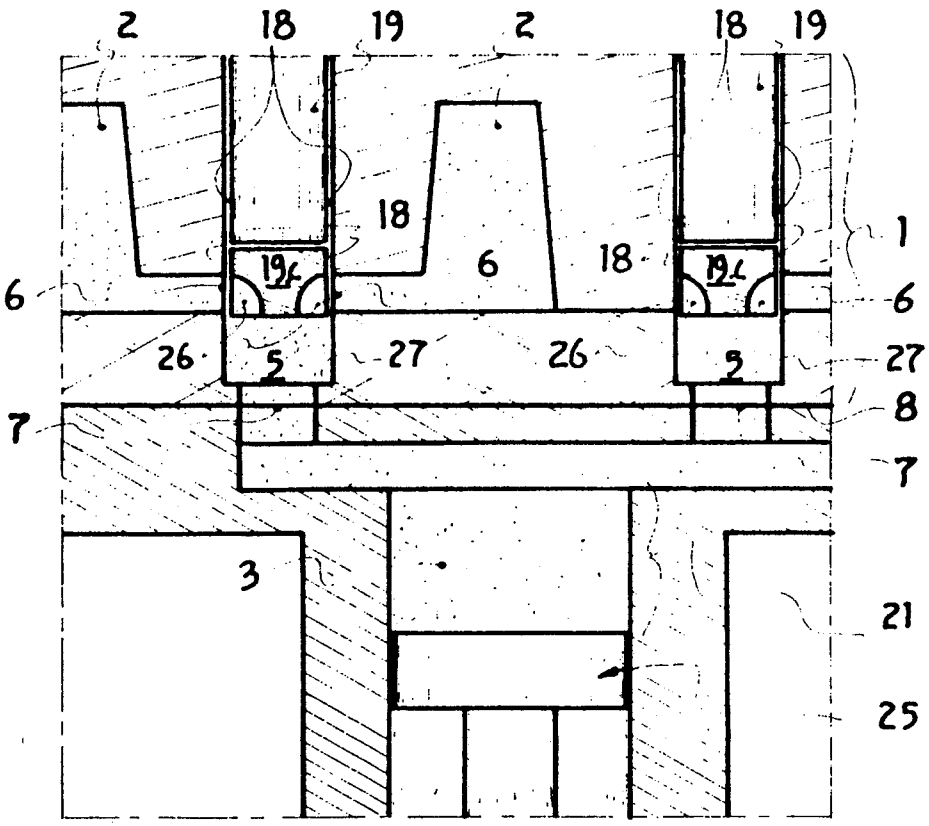
- fig: 8 -

METHOD FOR MOULDING OBJECTS AND INSTALLATIONS FOR CARRYING OUT THE PROCESS

THE INVENTION

The invention concerns a method for molding objects by feeding at least one consistent material into a mold where the material is solidified.

The invention also relates to means to implement this method.

More particularly, but not exclusively, the invention concerns the molding of objects usually embodied in clusters, namely objects in a plurality of cavities known as indentations fed by runners connected to a main pipe for feeding the liquid such as molten metal or molten or liquid plastic material.

As regards this type of production, the material mass, which solidifies in the runners, is frequently approximate to or clearly greater than the total mass of the objects to be molded.

Thus, a significant proportion of the material mass used, whether cast or injection-molded, is virtually waster, unless the material solidified in the runners can be recovered.

To overcome this drawback, it is known from patent FR-A-2.437.901 a method to firstly provide in a mold a plurality of indentations equipped with distinct runners and opening within a given plane, more particularly into the front surface of the mold, and, secondly, in order to feed the indentations, placing all the runners in communication with the surface of a molten material bath and then, by means of contraction, causing said material to rise until the indentations are filled up.

In this method, the mold may be substantially kept in contact with the bath until the material has solidified inside the indentations, which considerably slows down the casting cycles.

So as to avoid having to wait for solidification of the material in a mold filled by contraction, it is known from patent FR-A-2.007.747 the method for closing the inlet of the filling pipe roughly at the end of filling of the mold.

The above method enables the mold to be removed from the casting station before the material it contains is fully solidified, but, on the other hand, a certain quantity of this material remains in place in the runner of the indentation.

One result of the present invention is to provide a molding method which firstly makes it possible to remove each mold from the station feeding the material at about the time the mold has been filled, and secondly to considerably reduce or eliminate material losses in the runners.

To this end, the purpose of the invention is to provide a method of the above-mentioned type wherein, prior to closing the inlet to each runner of a cavity by using at least one closing device, known as the gate or runner face, the gate is first closed, followed by expelling the material contained in the runner.

Another purpose of the invention is to provide means for implementing the above-mentioned method.

BRIEF DESCRIPTION OF THE INVENTION

The invention shall be more readily understood on reading the following description given by way of nonrestrictive example accompanied by the annexed drawings which diagrammatically show:

FIG. 1: a casting installation,

FIGS. 2 to 5: a transverse cutaway view of a mold in various stages of casting an object, FIGS. 6 and 7: show variants of a mold allowing for implementation of the invention, FIG. 8: shows a cutaway view of a detail of an embodiment of one variant more particularly intended for plastic molding, FIG. 9: is a cutaway view of an example for implementing the invention relating to low-pressure molding, FIG. 10: is a top view of an apparatus for implementation of the invention.

DETAILED DESCRIPTION OF THE INVENTION

Figure 5:
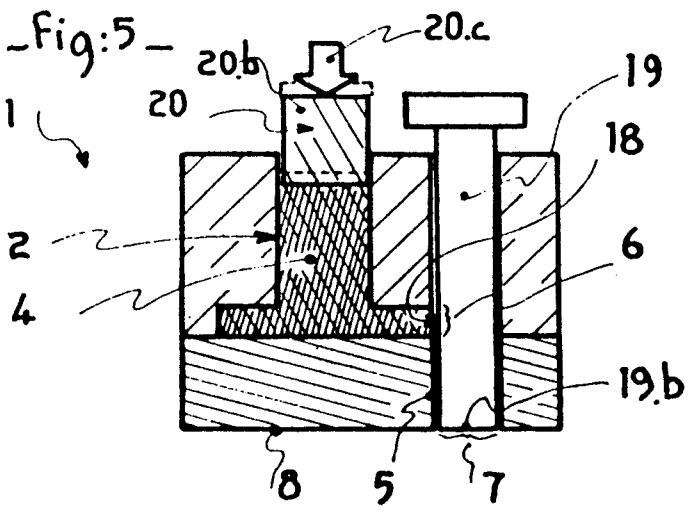
Figure 2:
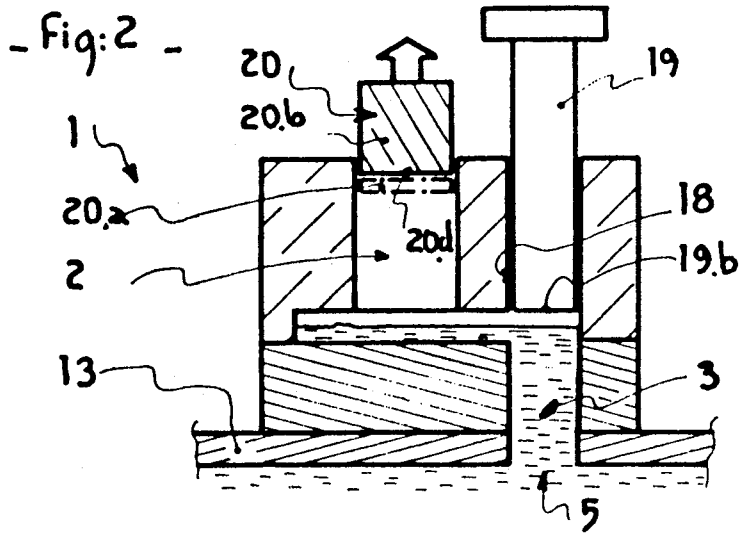
Figure 3:
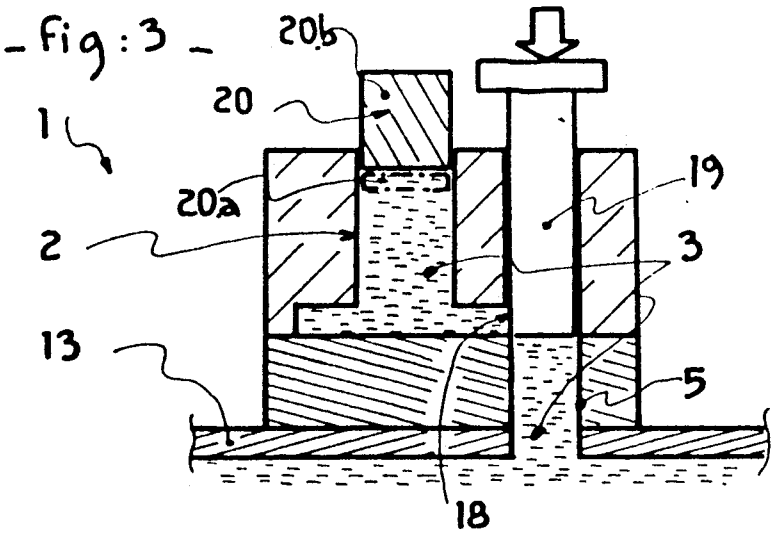

Referring to the drawings, there is shown a mold 1 comprising at least one cavity 2 in which a molten material 3 can be cast so as to form an object 4 (FIG. 5) after solidification.

Figure 1:
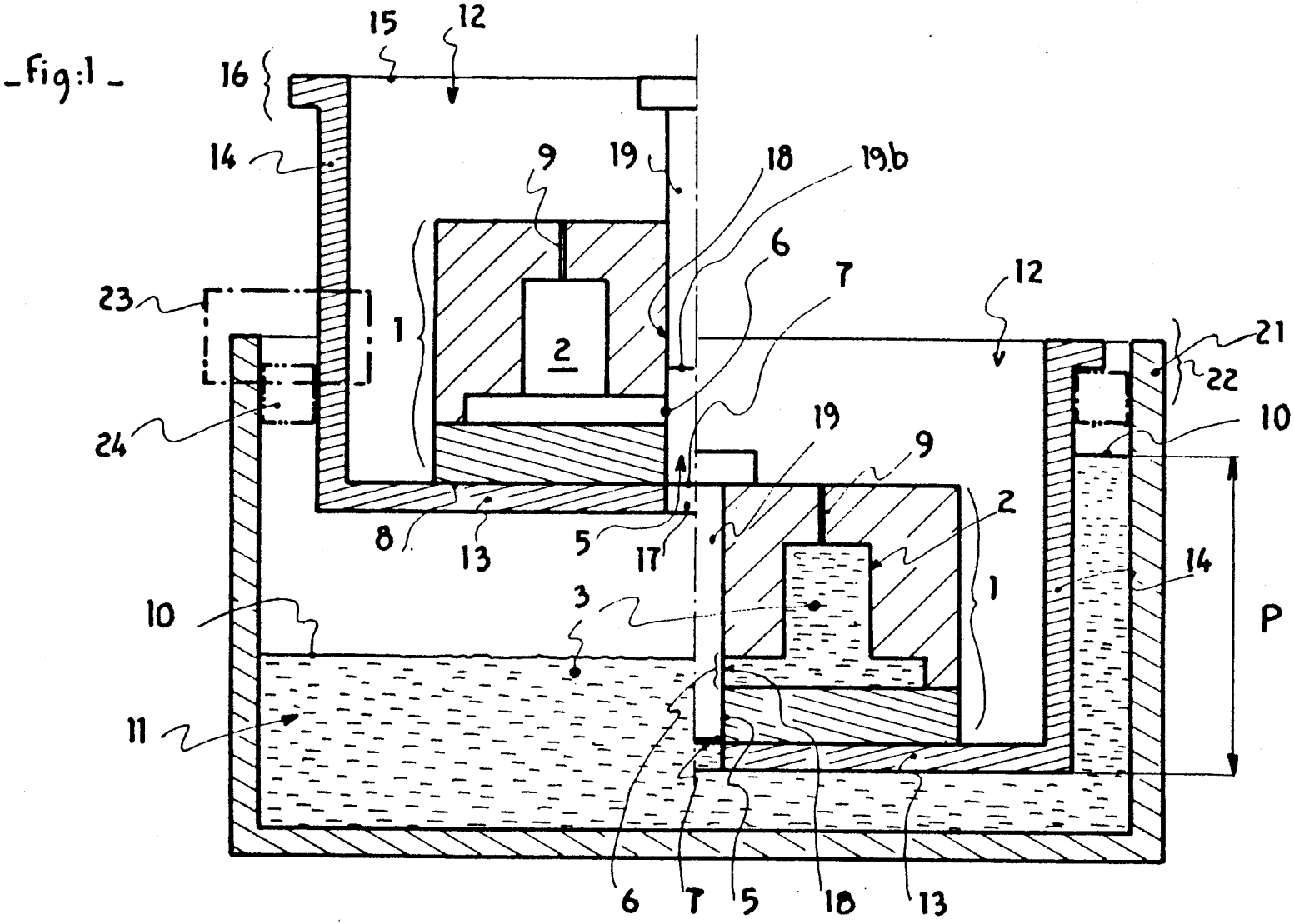
Figure 4:
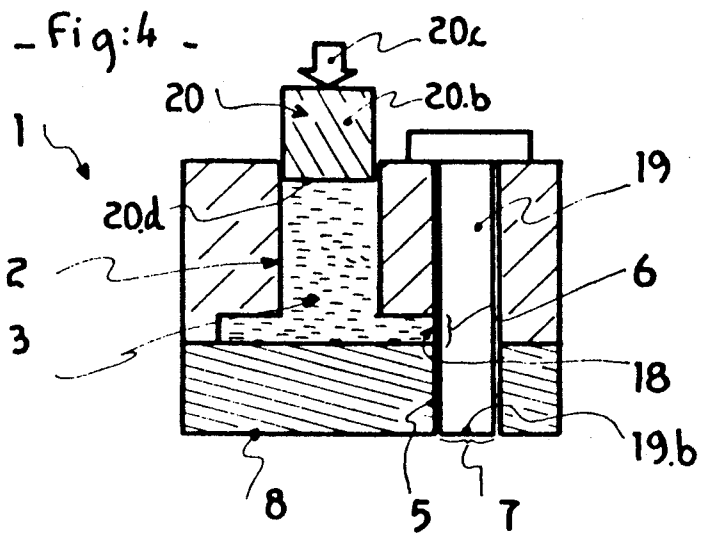

Also shown in FIG. 1, the mold comprises at least one runner 5 for the cavity 2 filled with the material 3. The runner 5 opens into at least one cavity 2 via a face known as a feeding or gate face and hereafter simply known as the gate face 6.

The runner 5 also opens outside the mold via, for example, a feed opening 7 located in the front face 8 of the mold, namely its inner face 8 when it is oriented in the use position.

In a known mode, the mold also includes pipes 9 for degassing the cavity 2, but in order to simplify the drawing, only one of these pipes 9 is shown.

As clearly shown on FIGS. 2 to 5, in order to fill the cavity 2 with molten material, the cavity is first fed by the runner 5 and then, after filling, the feed opening 7 of the runner is closed so as to retain the molten material in the cavity 2.

However, according to one characteristic of the invention, before closing the feed opening 7 of each runner 5 of a cavity 2, the gate casting face 6 of the channel of the cavity 2 is closed by means of at least one closing device. The molten material 3 contained in the runner 5 is then expelled out of the mold 1.

In accordance with the invention, each casting gate face 6 is closed by generally observing the amount of material the object 4 is required to have at the level of this face 6.

One of the advantages of the method of the invention is that, owing to the elimination of materials contained in the runner, non-interconnected parts are obtained once the mold is opened, which means that shrinkage, which occurs during solidification of the molded material, only affects the volume of the part thus making it possible to mold materials containing a high percentage of shrinkage such as bronze in multi-impressions.

Another advantage of the method, generated by the fact that the molded objects are separated from the feeding system following filling of indentations, is that it is possible to dispose one or more indentations around a single closing device and multiply the closing devices in an available mold surface, without increasing the difficulty of obtaining good quality molded objects.

Although not represented on the drawing, the mold can be divided into sets and/sub-sets of indentations mobile with respect to each other.

Up until now, this technical possibility was applicable only to molding plastics and thus is becoming applicable to metals by implementing the method according to the invention.

According to the invention, if considered necessary, during solidification in at least one cavity 2, shrinkage of the molten material is compensated for and to this effect:

prior to casting of the molten material 3 in each previously mentioned cavity, depending on the volume used, the material shrinkage value is assessed with regard to its nature and casting conditions, such as its temperature, provision is made to at least indirectly link with each cavity at least one additional cavity 20*a* whose volume roughly equals the estimated shrinkage value and, upon casting of the material into the mold, firstly the cavity 2 and secondly each additional cavity 20*a* connected to it filled, and then after closing of the inlet of each runner of the cavities 2 and 20*a*, the molten material contained in each additional cavity 20*a* is progressively expelled towards the cavity 2 linked to it, this more particularly being effected by generally observing the geometry and dimensions of the object to be formed in the cavity 2.

In a preferred mode for implementing the casting method according to one of the previously mentioned characteristics, each cavity of a mold is filled with molten material by immersing the cavity under the surface 10 of a bath 11. The mold could also be filled via another technique, for example, via a low-pressure molding technique.

In accordance with the invention, according to this principle, so as to fill at least one cavity of at least one mold:

at least one receptacle 12 is provided comprising firstly a bottom 13, side walls 14 and an access opening 15 at its upper part 16, and secondly in its bottom at least one orifice 17 is provided having a cross-section roughly equal that of the runner 5 of a mold 1, and then the mold in question is placed on the bottom 13 of the receptacle 12 by putting the feed opening 7 of the runner 5 in communication with the orifice 17 provided in the bottom of the receptacle, then the receptacle is at least partially immersed in the bath containing the molten material. The immersion occurring to a depth P measured from the bath surface and sufficient at least so as to allow for complete filling of the cavity under the effect of the pressure of the molten material, and this pressure of the molten material is maintained until roughly after all the casting gate faces of the mold in question have been closed.

After closing all the casting gate faces, the receptacle is made to emerge so as to annul the pressure of the molten material at the level of the bottom orifice 17, this being effected in order to remove the mold from the receptacle, preferably without canceling the contact between the surface of the bath and the bottom of the receptacle.

Preferably: the feed opening 7 of each runner cooperates with the opening provided in the bottom of the receptacle by a nozzle or nose (not shown) ensuring imperviousness between the mold and the receptacle.

When the mold has several runners and consequently several feed openings, the bottom of the receptacle comprises as many openings as needed arranged according to the same disposition to allow for passage of the molten material.

The means for implementing the invention mainly comprise:

at least one closing device 18 for closing each gate face 6 of a molding cavity 2 and, at least one device 19*b* for expelling the material retained in a runner following closing of the face communicating with the runner.

According to the invention, the closing device 18 of each casting gate face is designed to carry out its function by observing the geometry of the molded object.

For example if the casting gate face is curved, the closing device 18 is provided with a curved shape.

In one form of embodiment, the runner 5 is tangent to one of the faces of the molded object so as to constitute the casting gate face of the object and is, in particular, roughly cylindrical and orthogonal to the inner face of the mold. A piston, known as a primary piston 19, 19*a*, cooperates with this runner in a sliding way so that via its lateral cylindrical face 18 it closes the casting gate face and via its front face 19*b* it expels the molten material from the runner.

Although not represented on FIGS. 1 to 8, the piston 19, 19*a* cooperates with a device for controlled locking in all positions and/or at least the closed position of the gate face.

In another form of embodiment, when the object to be molded has an axial core pin 19*a*, each runner 5 is fitted into the mold coaxially to the core pin 19*a* so as to open into one of the faces of the cavity where the core pin is connected. Each previously mentioned core pin is mounted mobile in translation on its axis and comprises a nose or nozzle 19*c* able to be engaged in the runner 5. The nozzle has a transversal section at least sufficient to seal off the casting gate face of the runner in the cavity and being long enough to be able to expel the molten material from the runner via its extreme face 19*b*.

Also, the invention comprises at least one device 20, 20*a*, 20*b*, 20*c*, 20*d* for compensating for shrinkage of the molten material during solidification: said device comprises at least one cavity 20*a* with a volume equal to the shrinkage volume of the molten material during its solidification and at least one secondary piston 20*b* driven by a driving mechanism 20*c* including a face 20*d* cooperating with the molten material so as to compress the material in the cavity 2.

The driving mechanism 20*c* may, for example, consist of a jack.

As clearly represented on FIG. 6, the pistons known as the primary and secondary pistons can be coaxial or parallel.

To make the invention more readily understood, the molds have been symbolically represented and all non-mandatory means have been eliminated such as reheating and/or cooling circuits, devices for mounting and/or dismounting the molding parts of the mold, etc.

The above-mentioned casting installation comprises mainly:

at least one tank 21 containing the bath of molten material; the tank being open at its upper part 22, means for maintaining the temperature of the bath of the molten material, at least one device for moving the bath with respect to the vat and/or receptacle required to receive the mold in such a way as to be able to at least partially immerse the cavity of the mold under the level of the bath containing the molten material.

Preferably, the installation further comprises, between the upper edge of the tank and the side wall of the receptacle, a sealing device specially intended to keep the bath containing the molten material in contact with the environment of the installation.

The environment of installations is not represented, but it is understood that this type of installation lends itself to the automation of casting operations.

The installation is diagrammatically shown on FIG. 10.

In an embodiment variant, more particularly but not exclusively intended for plastics (FIG. 8), the mold 1 comprises means for closing the gate face for feeding the indentation, said closing means, following closing of said gate face 6, continues acting so as to expel the material from the runner 5 to the feed opening 7 of the front face 8 of the mold 1 indirectly connected to the tank 21 containing the consistent material.

For a molding operation, the material 3 is expelled from the tank 21 by means of a piston 25.

It, in turn, expels the closing means 18 until the latter frees the gate face 6.

Advantageously, the radial face of the closing means 19 controlling the gate face 6 has at least one fine groove 26 for feeding the indentation 2.

The closing means comprises a pusher 19 and a pusher nose 19*c*, able to move freely with respect to the pusher 19 in the runner as far as an extreme stop 27 determining its position at the end of the movement expelling the material from the runner 5, and a device (not represented) determining its position during feeding of the indentation 2 by each groove 26.

Once separated from the pusher 19, the pusher nose 19*c* can, to maintain a partial vacuum in the tank 21, remain in support against its extreme stop, whereas the pusher is raised up.

FIG. 9 shows an example of implementing the invention by means of the molding technique known as the low-pressure technique.

There exists a plurality of nozzles 28 making it possible to feed the mold from a low-pressure furnace (not shown).

The environment of the installations is not represented, but it is understood that this type of installation lends itself to automation of casting operations.

FIG. 10 diagrammatically represents such an installation.

FIG. 10 has thus symbolically represented the various stations of such a casting installation.

These various stations 30 to 37 are, for example, interconnected by a device 38 for conveying at least one mold, the device preferably joining together the stations as a closed loop.

Molding of the material is carried out at the station 30, whereas solidification is carried out at the station 31.

Opening of the mold is effected at the following stations 32, and 33 and then the molded part is ejected from each cavity of the mold.

The following stations 34, 35 and 36 respectively enable the molds to be cleaned, allow for any possible change of tooling, and enable the mold to be coated with a material optimizing casting and/or drawing of the part.

Closing of the mold is effected at station 37.

I claim:

1. Apparatus for molding objects comprising a source of liquid molding material, at least one mold cavity, at least one runner connecting the source to the mold cavity, a gate between the runner and the mold cavity, means for opening the gate to fill the mold cavity and closing the gate when the mold cavity is full of liquid material, and means for expressing the liquid material from the at least one runner when the gate is closed, further including an additional cavity communicating with the mold cavity, and means for expressing liquid material from the additional cavity into the mold cavity as solidification causes the material in the mold cavity to shrink, wherein the additional cavity has a volume substantially equal to volume of shrinkage of the solidifying liquid in the mold cavity, further including at least one tank containing the source of molten material, said tank being open at its upper part, means for maintaining the temperature of the source of the molten material and, at least one device for moving one with respect to the other of the tank or mold cavity required to receive the mold so as to at least partially immerse the cavity of the mold under the level of the bath containing the material.

2. Apparatus for molding objects comprising a source of liquid molding material, at least one mold cavity, at least one runner connecting the source to the mold cavity, a gate between the runner and the mold cavity, an axial core pin for opening the gate to fill the mold cavity, closing the gate when the mold cavity is full of liquid material, and expressing the liquid material back to said source from the at least one runner when the gate is closed.

3. The apparatus as defined in claim 2 wherein the object to be molded includes at least one said axial core pin, each runner disposed in the mold coaxial to an axis of the core pin so as to open into a face of the mold cavity where the face is connected to said core pin, each said core pin having translation means mounted on its axis and said core pin has a nose able to be engaged in the runner, said nose having at least a transverse section sufficient to seal off the gate of the runner in the cavity and a length at least sufficient to expel the liquid material from said runner.

4. A method for molding an object comprising the steps of filling a mold cavity from a liquid pool of mold filling material via a runner; closing a gate between the mold cavity and the runner when the mold is full with a plunger and, while the gate is closed, forcing the mold filling material from the runner back into the pool of mold filling material with said plunger.

5. The method as defined in claim 4 further including filling an additional cavity associated with each cavity with a quantity of consistent material substantially equal to the volume of shrinkage of the mold cavity, closing the mold cavity and the additional cavity from the runner and thereafter expelling the material from the additional cavity into the mold cavity.

* * * * *